US012799944B2

(12) United States Patent
Fukumasu

(10) Patent No.: US 12,799,944 B2
(45) Date of Patent: Nov. 17, 2026

(54) AIR BLOWER

(71) Applicant: Iris Ohyama Inc., Sendai (JP)

(72) Inventor: Kazuhito Fukumasu, Kakuda (JP)

(73) Assignee: Iris Ohyama Inc., Sendai (JP)

( * ) Notice: Subject to any disclaimer, the term of this patent is extended or adjusted under 35 U.S.C. 154(b) by 22 days.

(21) Appl. No.: 18/839,292

(22) PCT Filed: Feb. 3, 2023

(86) PCT No.: PCT/JP2023/003563
§ 371 (c)(1),
(2) Date: Feb. 14, 2025

(87) PCT Pub. No.: WO2023/162635
PCT Pub. Date: Aug. 31, 2023

(65) Prior Publication Data

US 2026/0009391 A1 Jan. 8, 2026

(30) Foreign Application Priority Data

Feb. 22, 2022 (JP) ..... 2022-026134

(51) Int. Cl.

| | |
|---|---|
| ***F04D 25/08*** | (2006.01) |
| ***F04D 19/00*** | (2006.01) |
| ***F04D 29/52*** | (2006.01) |
| ***F04D 29/64*** | (2006.01) |

(52) U.S. Cl.
CPC ..... *F04D 25/08* (2013.01); *F04D 19/002* (2013.01); *F04D 29/522* (2013.01); *F04D 29/646* (2013.01)

(58) Field of Classification Search
None
See application file for complete search history.

(56) References Cited

FOREIGN PATENT DOCUMENTS

| | | | |
|---|---|---|---|
| CN | 111075769 | A | 4/2020 |
| CN | 212106332 | U | 12/2020 |
| CN | 217176941 | U | 8/2022 |
| JP | S63-297795 | A | 12/1988 |
| JP | 2011-208910 | A | 10/2011 |
| JP | 2013-185561 | A | 9/2013 |

OTHER PUBLICATIONS

Li (CN 212106332 U) + machine translation (Year: 2020).*
PennEngineering (https://www.youtube.com/watch?v=7GwxlGoFgpl—published Dec. 13, 2017) (Year: 2017).*
JP-S60192897-A + machine translation (Year: 1985).*
Xiao et al—CN-111075769-A + machine translation (Year: 2019).*
JP-S63297795-A + machine translation (Year: 1988).*
Chen et al—CN-212536164-U (Year: 2021).*
International Preliminary Report on Patentability (Chapter I) and Written Opinion of the International Searching Authority issued in PCT/JP2023/003563; issued Aug. 27, 2024.
International Search Report issued in PCT/JP2023/003563; mailed Apr. 18, 2023.

* cited by examiner

*Primary Examiner* — Juan G Flores
(74) *Attorney, Agent, or Firm* — Studebaker Brackett PLLC

(57) ABSTRACT

An air blower includes a blowing part including: a fan; a motor for driving the fan; a motor cover holding the motor; and a case part storing the motor cover, in which the case part includes a first member fixed to the motor cover, and a second member connected to the first member detachably, having an air intake port through which air that the fan takes in flows.

6 Claims, 16 Drawing Sheets

AIR BLOWER

TECHNICAL FIELD

An aspect of the present invention relates to an air blower such as a circulator.

BACKGROUND ART

There is a conventional circulator used for agitating and circulating air in a space. Patent Document 1 discloses a circulator including an air flow path 3 communicating from an air intake port 4 in a rear surface to an air discharge port 5 in a front surface, in which a blower fan 6 arranged in the air flow path 3 generates an air flow, and indoor air is circulated by the air flow.

CITATION LIST

Patent Document

Patent Document 1: Japanese Unexamined Patent Application Publication No. 2011-208910

SUMMARY OF THE INVENTION

Technical Problem

The conventional circulator has a configuration in which air is taken in from the air intake port provided in a cover in the rear surface, and the air intake port is partitioned by a plurality of ribs in order to prevent a foreign matter from contacting the fan. On the other hand, in using the circulator, dust is accumulated in the ribs, so that the air flow may become non-smooth or sanitation is impaired. However, since the cover in the rear surface is fixed to the fan and a motor cover supporting a motor for rotating the fan and a support leg is inserted through the cover, the entire cover in the rear surface is difficult to be detached, so that the dust accumulated in the ribs is difficult to be removed.

Solution to Problem

In order to solve the above problem, the present invention provides an air blower as below.

An aspect of the present invention is an air blower including a blowing part. The blowing part includes a fan, a motor for driving the fan, a motor cover holding the motor and a case part storing the motor cover. The case part includes a first member fixed to the motor cover and a second member connected to the first member detachably, having an air intake port through which air that the fan takes in flows.

According to the air blower having the configuration described above, since the second member can be detached from an air blower body including the first member, removing dust accumulated in the air intake port of the second member and cleaning the second member are facilitated.

In the air blower described above, it is preferable that the air blower further includes a support part including a support leg. The support leg is inserted into a slit of the case part and pivotally attached to the motor cover.

According to the air blower having the configuration described above, since an orientation of the fan can be easily rotated by rotating the motor cover with respect to the support leg, a configuration can be achieved in which air in a space arranged with the air blower is easy to effectively circulate.

In the air blower described above, a configuration is preferable in which the slit is formed in the first member.

According to the air blower having the configuration described above, there is no need to provide the slit between the first member and the second member, a configuration can be achieved in which it is easy to prevent interference between the support leg and another member caused by a dimensional error between the first member and the second member or other cause.

In the air blower described above, it is preferable that, in a cross section of a bonding part of the first member and the second member, each of the first member and the second member has one surface side projecting with respect to the other surface side, and the first member and the second member are bonded to each other such that a convex part of the first member faces a concave part of the second member and a concave part of the first member faces a convex part of the second member.

According to the air blower having the configuration described above, since a configuration is achieved in which the first member and the second member are bonded by a mating structure, a gap between the first member and the second member can be made inconspicuous. Even when there is a small gap between the first member and the second member, occurrence of rattling can be suppressed. Particularly, when the first member and the second member are formed of a resin, a manufacturing variation such as a small strain is easy to occur, and therefore, the configuration is effective. Furthermore, in the configuration, strength of each bonding end of the first member and the second member can be enhanced so it is difficult for the members to be broken.

In the air blower described above, it is preferable that the second member have a shape whose lower side is opened, and the first member have a shape extending to an opened portion of the second member.

According to the air blower having the configuration described above, a configuration is achieved in which the first member covers the opened portion of the lower side of the second member, and thus a configuration in which the first member is stably supported can be achieved.

In the air blower described above, it is preferable that the first member and the second member each have the convex part and the concave part fitting each other in a surface facing an attaching and detaching direction of each other.

According to the air blower having the configuration described above, by fitting the convex part and the concave part to each other, the first member and the second member can be easily positioned. Particularly, in the air blower of the present invention, since a user detaches the second member and the second member is attached to the first member every time of the detachment, such a configuration in which positioning is easy is effective.

In the air blower described above, it is preferable that the bonding part of the first member and the second member have a pair of vertical sides extending in an up and down direction and a lateral side connecting upper ends of the vertical sides. The first member and the second member have a first convex part and a first concave part and a second convex part and a second concave part fitting each other in a surface facing an attaching and detaching direction of each other. The air blower has a configuration in which the first convex part and the first concave part are provided in the vertical sides and the second convex part and the second concave part are provided in the lateral side.

According to the air blower having the configuration described above, even when an external force in the vertical direction or the lateral direction is applied to any one of the first member and the second member, rattling can be suppressed due to an action of the convex parts and the concave parts provided in the vertical sides and the lateral side fitting each other.

In the air blower described above, it is preferable that the concave part be a long hole and the convex part be a protrusion provided so as to extend along the long hole at a position corresponding to the long hole. The convex part may be a protrusion provided in plural along the long hole at a position corresponding to the long hole.

According to the air blower having the configuration described above, even when a positional shift occurs between the first member and the second member, the first member and the second member can be easily fitted by fitting the convex parts and the concave parts. Particularly, when the first member and the second member are formed of a resin, a manufacturing variation such as a small strain is easy to occur, and therefore, the configuration is effective.

In the air blower described above, it is preferable that at least one of the convex part and the concave part has a tapered surface at a position facing the concave part or the convex part provided in a surface that the at least one of the convex part and the concave part faces.

According to the air blower having the configuration described above, a configuration can be achieved in which the concave part and the convex part are easy to fit to each other. Furthermore, a configuration can be achieved in which the convex part is press fit to the concave part, so that occurrence of rattling between the first member and the second member can be suppressed.

In the air blower described above, it is preferable that, in the first member, a nut is embedded, the nut having a screw hole to which a bolt for connection with the second member is screwed in, and the second member includes a through hole to which the bolt is inserted.

According to the air blower having the configuration described above, the first member and the second member are stably connected to each other. Furthermore, even when the second member is repeatedly detached from the first member, the screw hole can be prevented from being broken. Furthermore, due to screwing of the bolt and the nut, even when a vibration occurs by operation of the air blower, the second member can be prevented from falling from the first member.

In the air blower, it is preferable that the air blower has a configuration in which the nut is embedded in the first member such that at least a part of a surface of a side formed with the screw hole is covered by a resin.

According to the air blower having the configuration described above, the nut for connection can be prevented from being lost.

DESCRIPTION OF EMBODIMENTS

Figure 1:
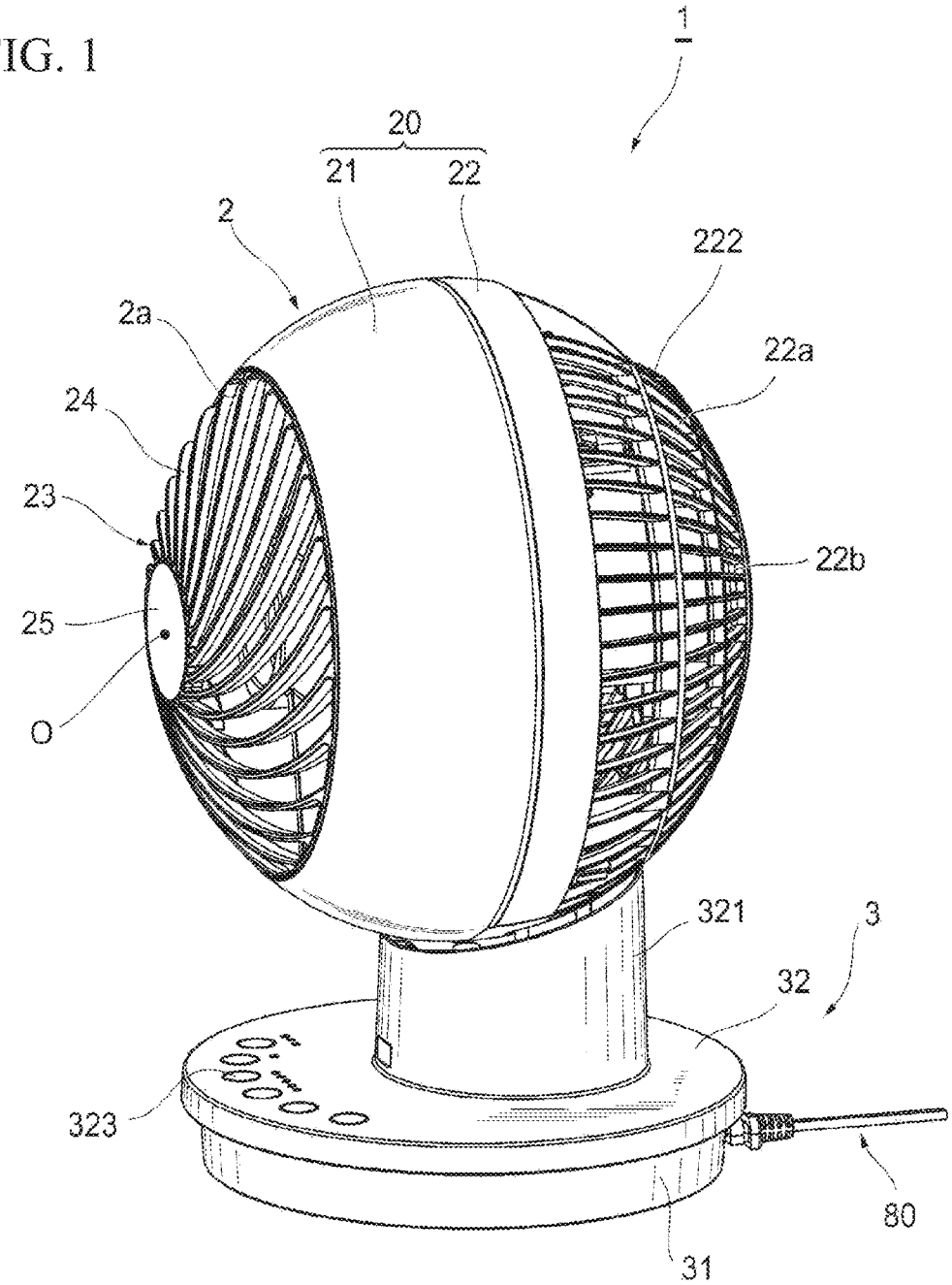
FIG. 1 is an external perspective view from the front of an air blower.

An embodiment of an air blower of the present invention will be specifically described below with reference to the drawings. However, the embodiment described below is merely an example of the present invention and is not intended to construe the technical scope of the present invention in a limitative manner. In each drawing, the same components are denoted by the same reference numerals and redundant description thereof may be omitted.

First Embodiment

[Exterior]

Figure 2:
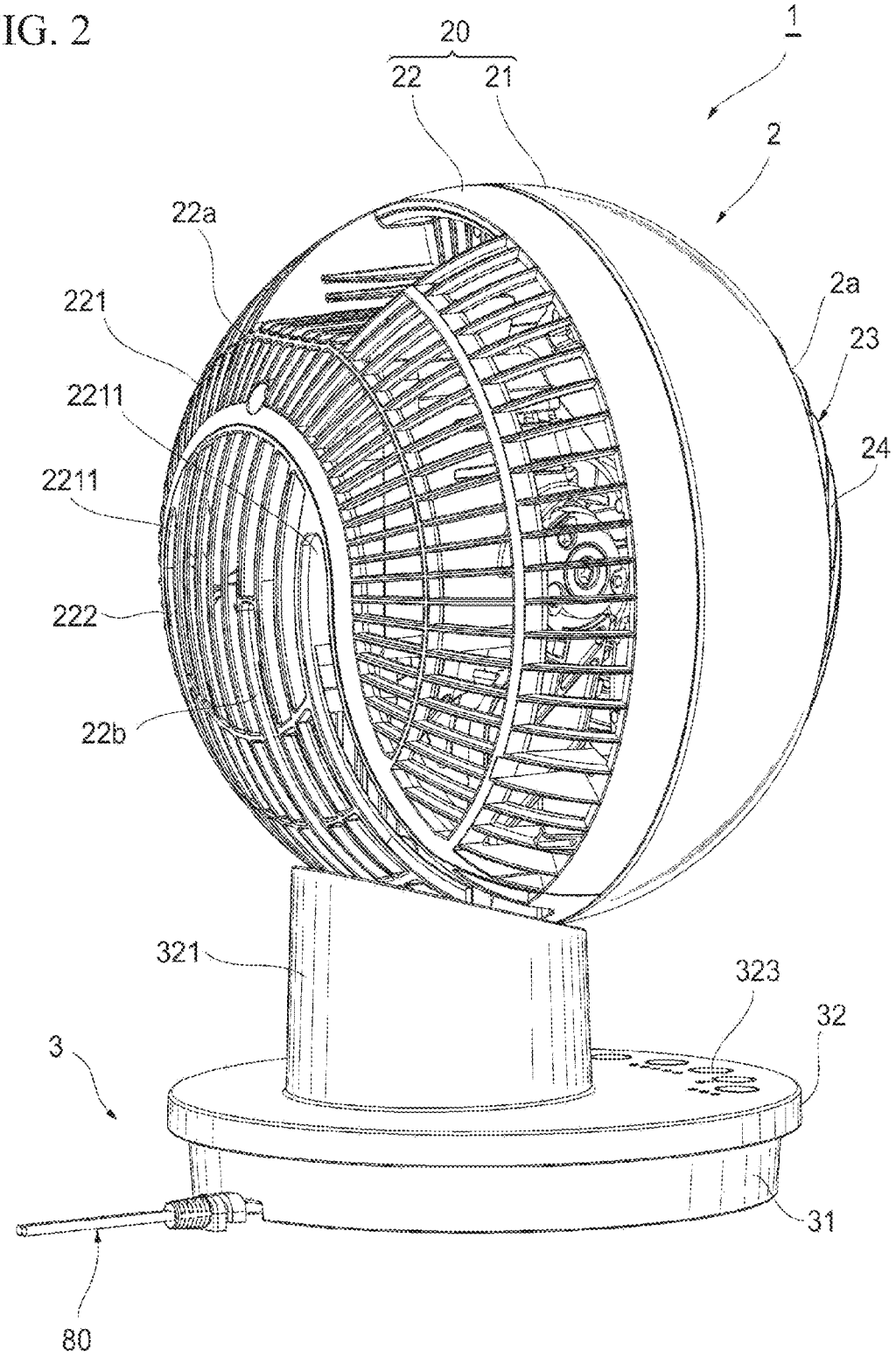
FIG. 2 is an external perspective view from the rear of the air blower.
Figure 3:
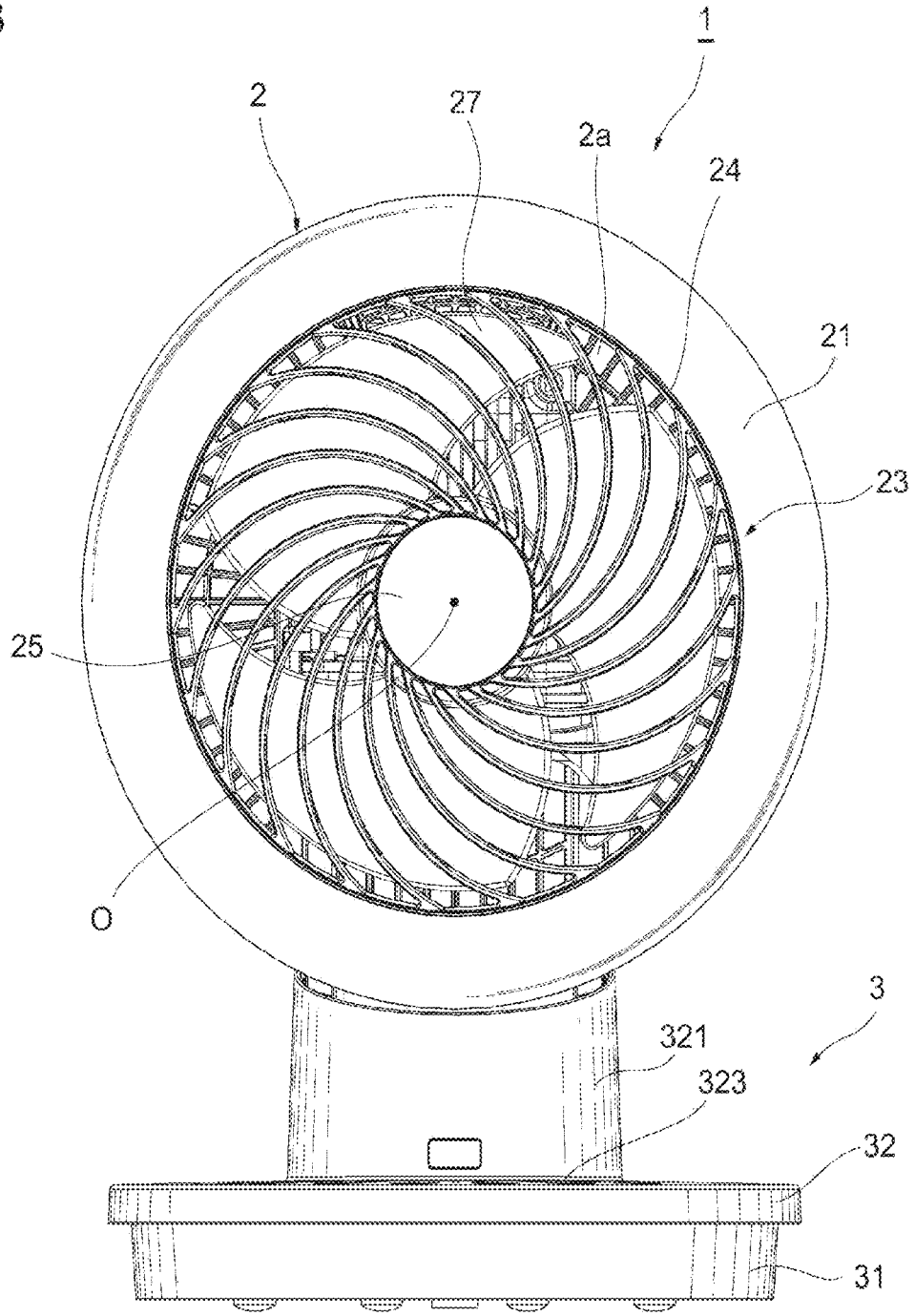
FIG. 3 is a front view of the air blower.
Figure 4:
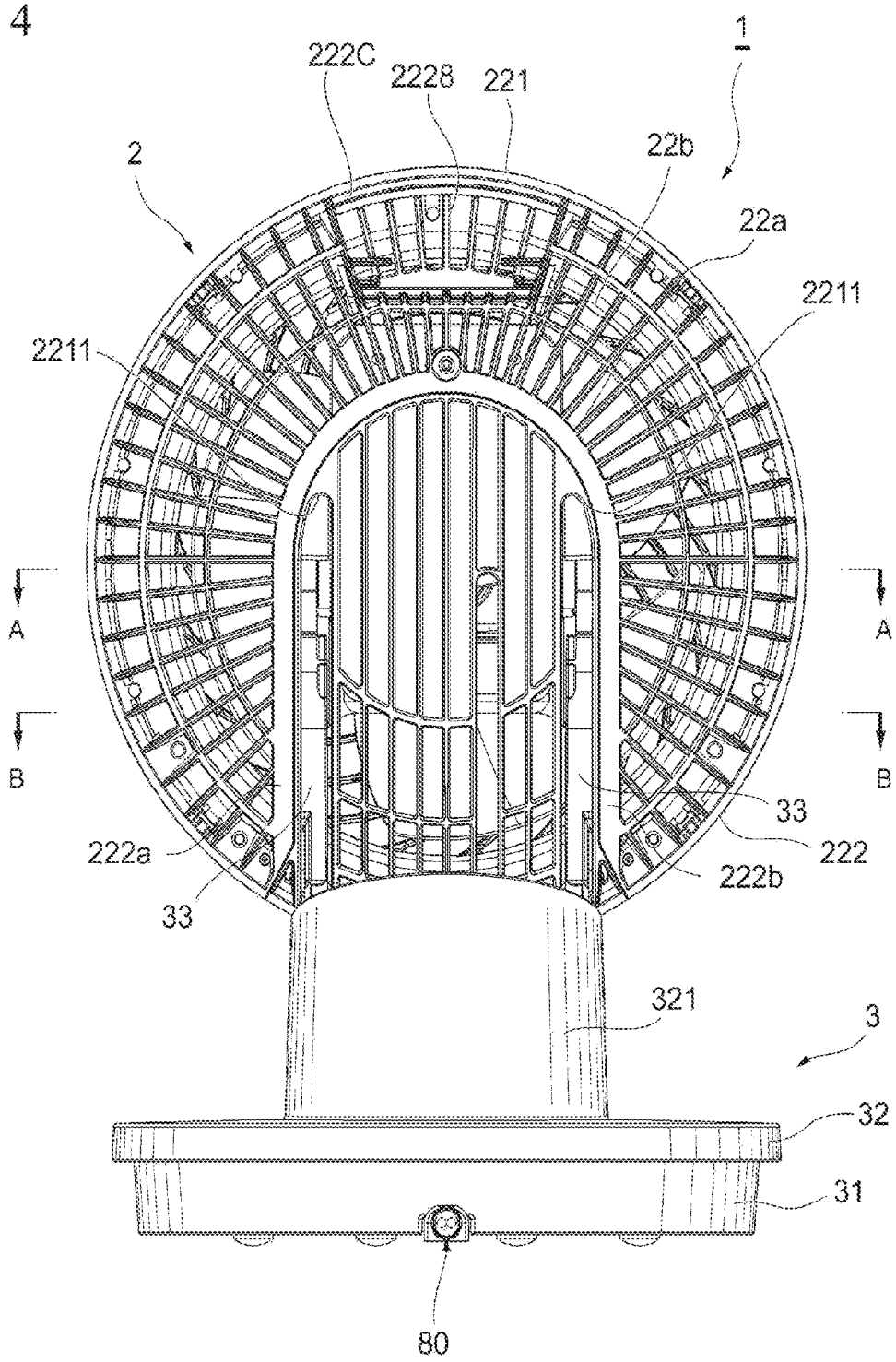
FIG. 4 is a rear view of the air blower.
Figure 5:
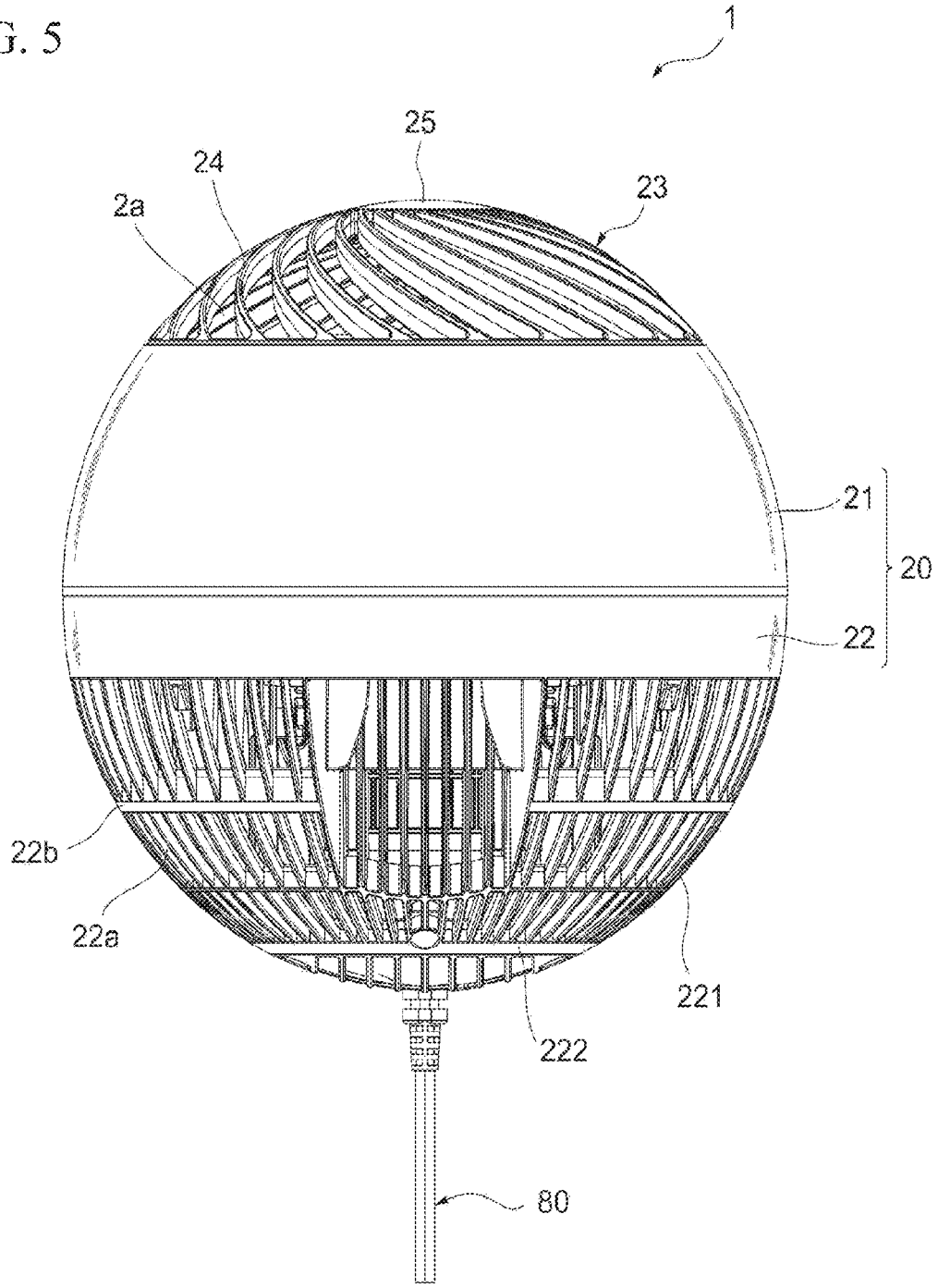
FIG. 5 is a top view of the air blower.

FIGS. 1 to 5 are external views of an air blower 1. FIG. 1 is a perspective view from the front, FIG. 2 is a perspective view from the rear, FIG. 3 is a front view, FIG. 4 is a rear view and FIG. 5 is a top view. The air blower 1 is configured such that air speed is enhanced by a spherical grill structure, and the air blower 1 looks compact due to a developed design of the spherical shape.

As illustrated in the drawings, the air blower 1 includes a blowing part 2 and a support part 3. The blowing part 2 is supported by the support part 3.

In the air blower 1, the blowing part 2 is supported by the support part 3 so as to be rotatable in a circumferential direction with respect to an axial direction extending in up-down direction. In other words, the blowing part 2 is rotatable in the lateral direction with respect to the support part 3. In this specification, this may be referred to as that the blowing part 2 has a right and left swing function. The air blowing part 2 is also rotatable in the up-down direction with respect to the support part 3.

The blowing part 2 includes a case part 20 having a spherical outer shell. The case part 20 includes a front case 21 and a rear case 22 that can be divided at a front-and-rear intermediate position. The case part 20 can be divided into the front case 21 and the rear case 22. This facilitates manufacturing of the front case 21 and the rear case 22 and enables arrangement of components in the inside of the case part 20 at the time of manufacturing to be easily performed.

[Specific Configuration of Each Unit]

[Blowing Part]

Figure 6:
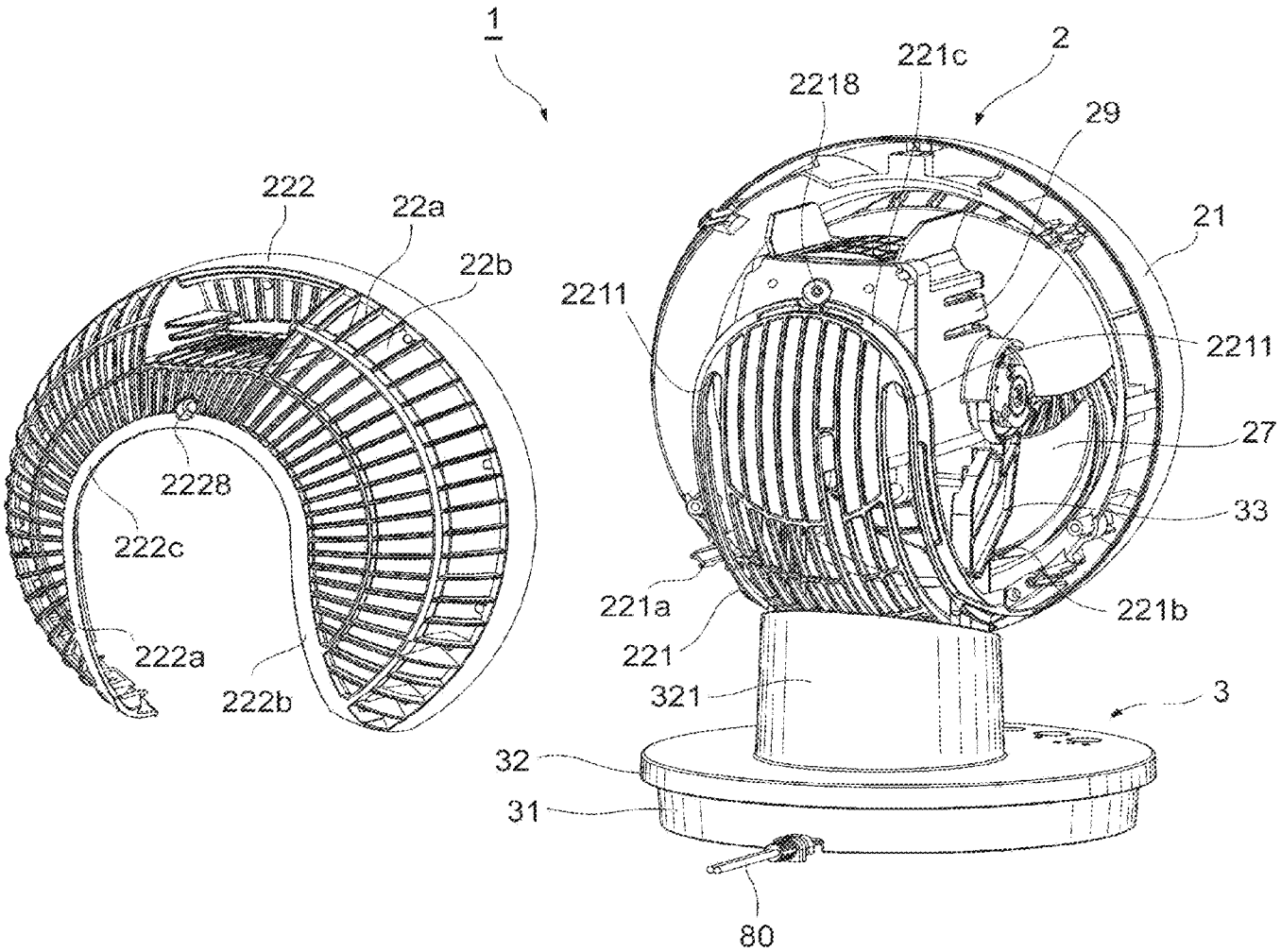
FIG. 6 is a perspective view from the rear of the air blower in which a second member has been detached.
Figure 7:
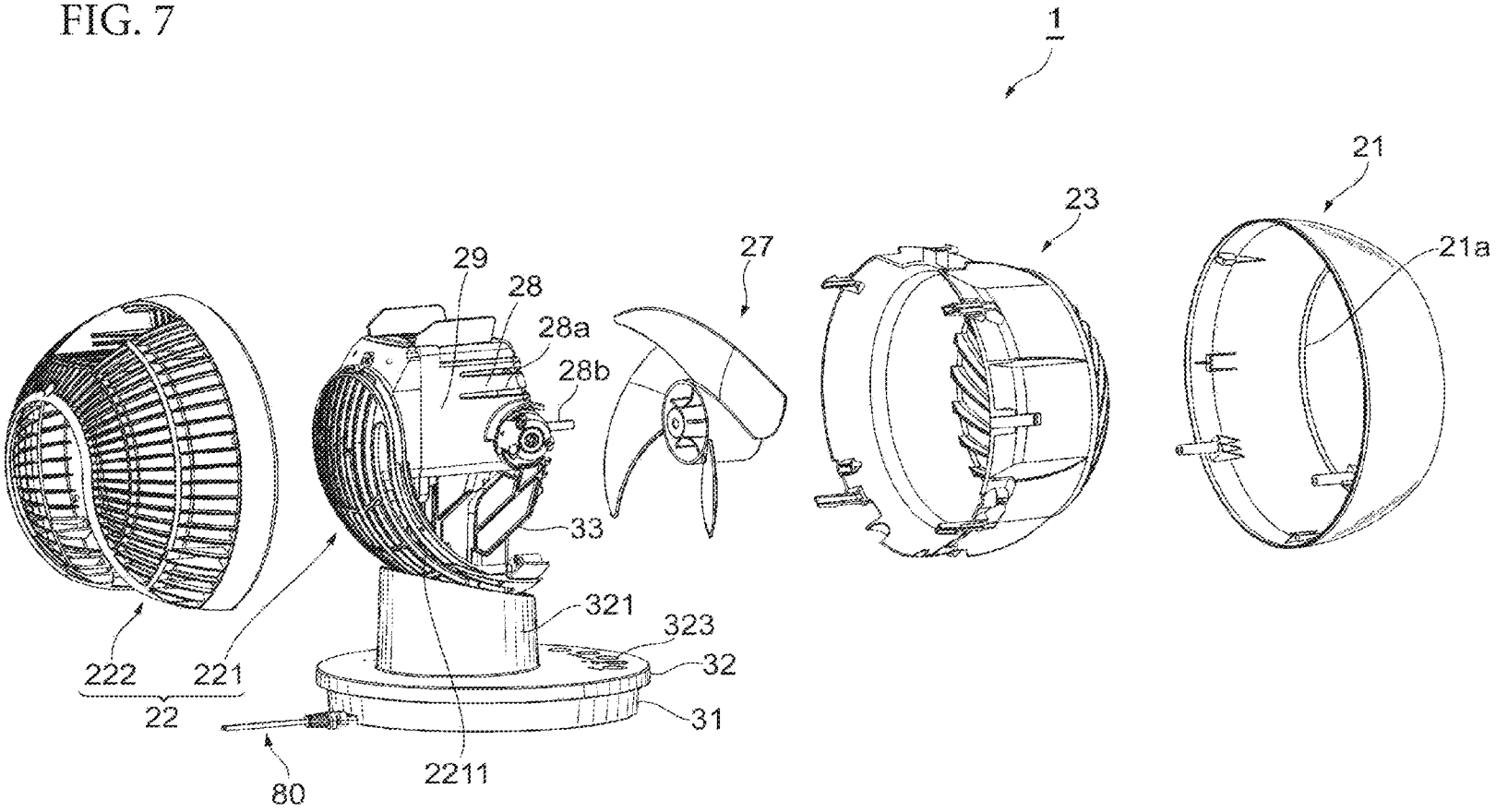
FIG. 7 is an exploded perspective view of the air blower viewed from the rear.
Figure 8:
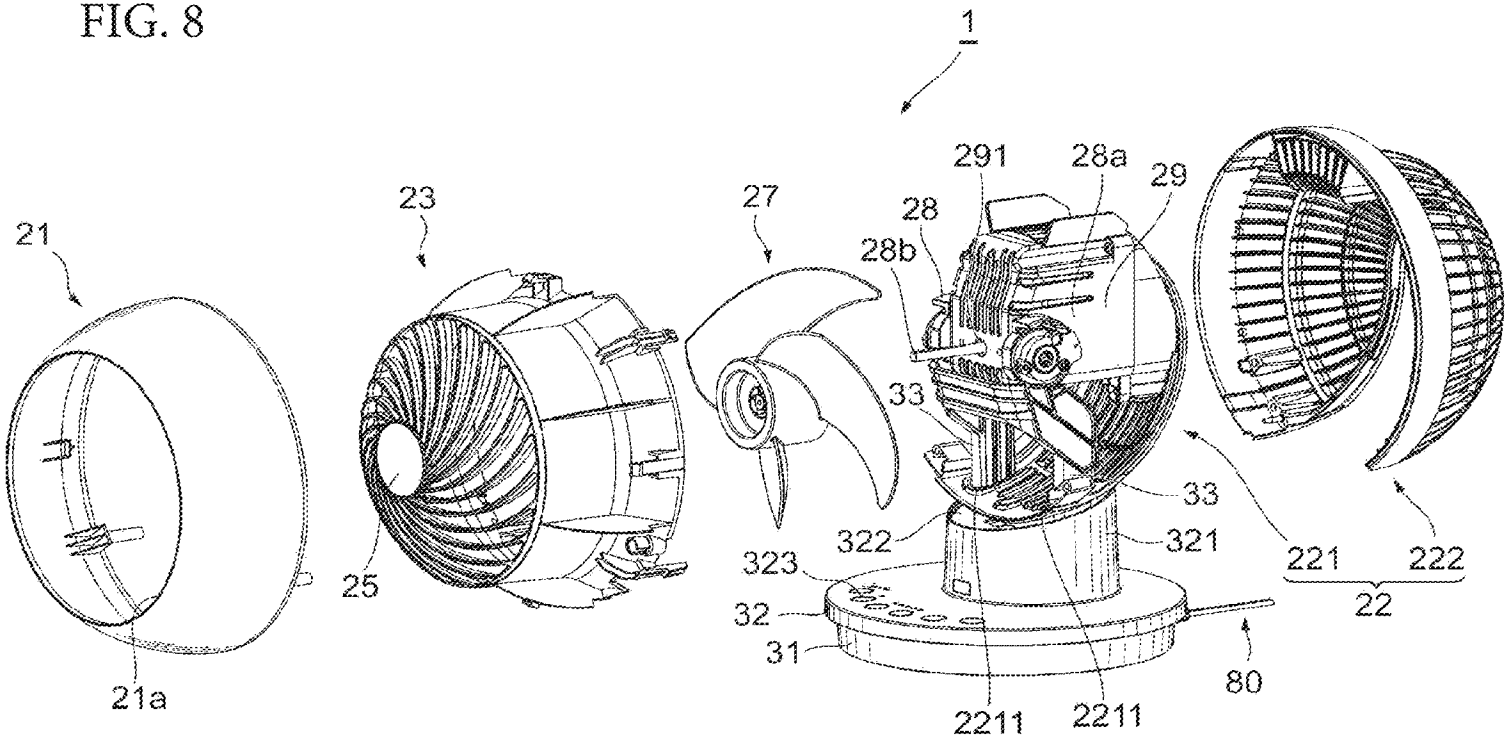
FIG. 8 is an exploded perspective view of the air blower viewed from the front.

FIG. 6 is a perspective view from the rear of the air blower 1 in which a second member 222 is detached from a first member 221 of the rear case 22. FIGS. 7 and 8 are exploded perspective views of the air blower 1, FIG. 7 is a view from the rear, and FIG. 8 is a view from the front.

As described above, the blowing part 2 includes the case part 20 including the front case 21 and the rear case 22. The blowing part 2 accommodates a fan 27, a motor 28 and a motor cover 29 inside of the case part 20.

As illustrated in FIGS. 7 and 8, the front case 21 is formed in such a shape that a front portion of a front half of the spherical shell is cut, and the front case 21 includes a circular opening 21*a* opened forward. This front case 21 can be formed of, for example, a synthetic resin material such as polypropylene. A spherical grill 23 is fitted to the circular opening 21*a* from the rear. That is, the front case 21 includes the grill 23 formed with a blow port 2*a* in a front side of the grill 23.

The front case 21 is connected with the first member 221 of the rear case 22 detachably from the first member 221. Although the connection may be made in a state where the front case 21 is fixed to the first member 221, connection in a detachable manner is useful in that the fan 27 is easy to clean. The front case 21 may be connected with the second member 222 detachably from the second member 222. However, since the second member 222 is detached from the first member 221 at the time of cleaning or the like, the front case 21 may be configured so as not to be connected with the second member 222 in order to make the detachment easy. The front case 21 is connected to the motor cover 29 via the first member 221, the motor cover 29 is connected to the support leg 33, and therefore, the front case 21 can be supported by the support leg 33 via the first member 221 and the motor cover 29.

The grill 23 is, for example, a front panel formed of a synthetic resin material having high impact resistance. In the present embodiment, the grill 23 includes a plurality of spiral fins 24 and is formed in a convex curved shape such that the plurality of fins 24 project gradually toward a center part O of the spiral. With such a configuration of the grill 23, when air is fed from the rear of the grill 23 and an air flow passes the grill 23, a spiral air flow flowing straight while forming spiral is generated. In the present embodiment, the grill 23 is formed such that the front surface forms a part of the spherical surface. The fin 24 is for guiding air and may be referred to as an "air guide plate".

As described above, in the air blower 1, the front case 21 including the grill 23 forms the hemisphere of the front side of the blowing part 2.

The rear case 22 is formed in such a shape that a rear portion of a front half of the spherical shell is cut, and the case part 20 is formed by the rear case 22 and the front case 21 being connected. The rear case 22 includes the first member 221 and the second member 222. The rear case 22 is formed in a semi-spherical shape by a plurality of cross-pieces 22*a* provided in the first member 221 and the second member 222. Air intake ports 22*b* for taking outside air in are formed in almost the entire surface of the rear case 22. As similar to the front case 21, the rear case 22 can be formed of, for example, a synthetic resin material such as polypropylene.

Figure 9:
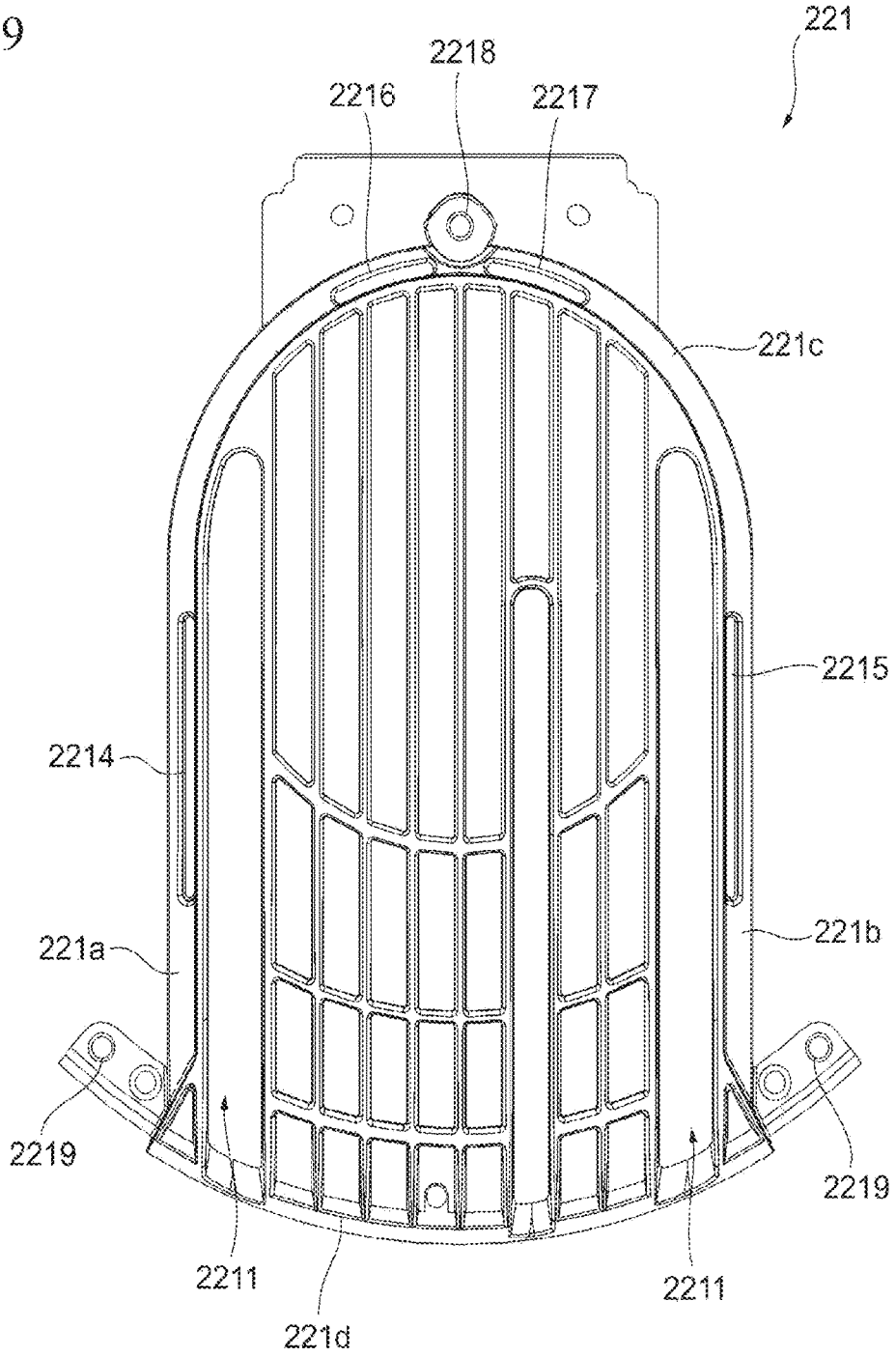
FIG. 9 is a plan view from the outside (rear) of a first member.

FIG. 9 is a view from the outside (rear) of the first member 221. As illustrated in FIGS. 4 and 9, the first member 221 has a shape extending in the up-down direction along the spherical surface. In an edge portion being the bonding portion of the first member 221 and the second member 222, the upper ends of the vertical sides 221*a* and 221*b* parallel to each other are connected via a curved lateral side 221*c*, and the edge portion has an inverted U-shape. An edge portion 221*d* being the bonding portion of the first member 221 and the front case 21 extends in an arc shape while facing the front case 21.

The first member 221 is supported by the motor cover 29 in a fixed state. That is, the first member 221 is fixed by the support leg 33 via the motor cover 29. A lower end at which the edge portion 221*d* of the first member 221 is located does not contact with the support part 3 and is in a floating state. The first member 221 is formed with two slits 2211 extending in the up-down direction. The support leg 33 is inserted in the slit 2211. The two slits 2211 are each along the curved shape of the first member 221 and extend in a straight shape in parallel to each other when viewed from the rear. The air blower 1 has an up-down swing structure in which the blowing part 2 rotates in the up-down direction with respect to the support part 3. In the structure, since the slits 2211 are provided, the support leg 33 does not interfere with the first member 221 at the time of the up-down swing. Providing the slits 2211 in the first member 221 enables improved positioning accuracy at the time of assembly. The slits 2211 may have a shape extending to the edge portion 221*d* being the bonding portion with the front case 21 or may be formed at a position away from the edge portion 221*d*.

Figure 10:
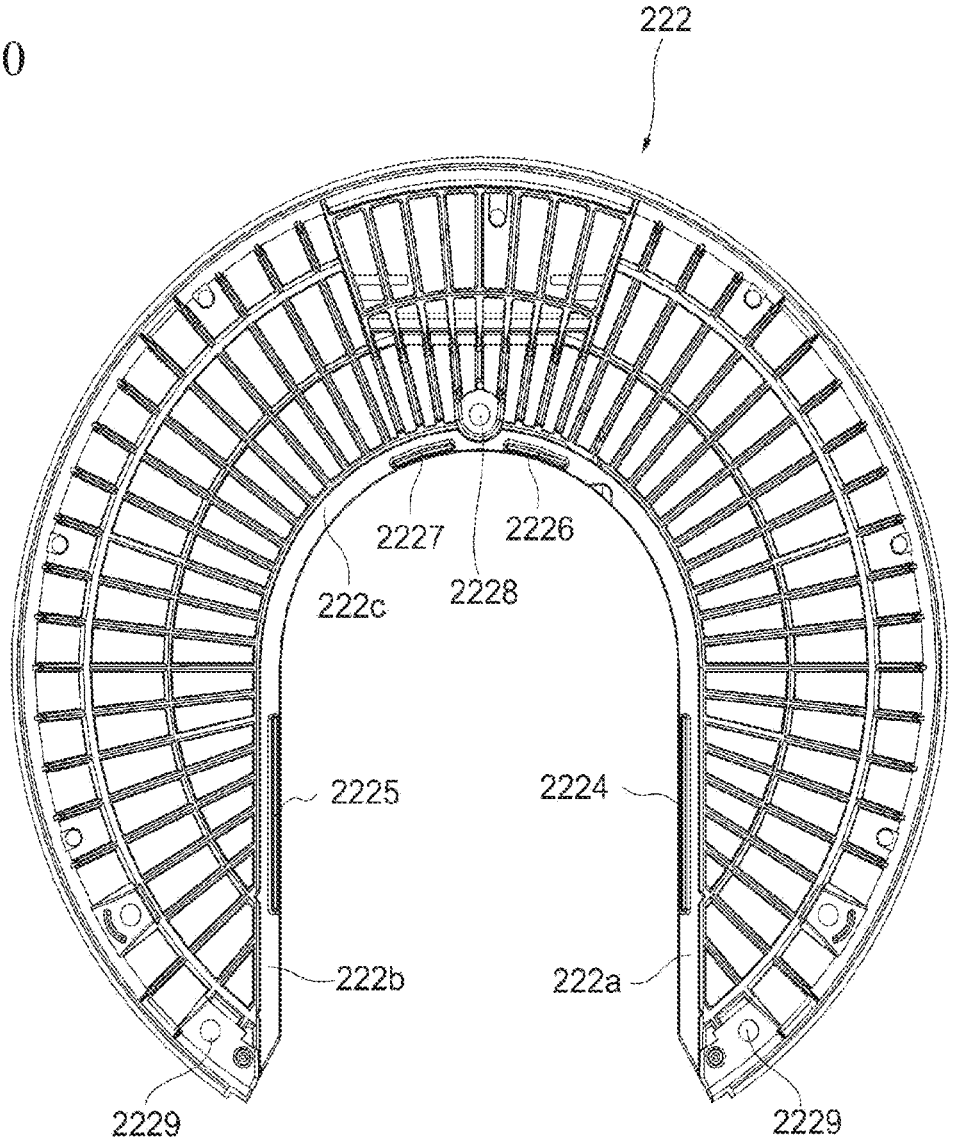
FIG. 10 is a plan view from the inside (front) of the second member.

FIG. 10 is a view from the inside (front) of the second member 222. As illustrated in FIGS. 4 and 10, the second member 222 has a shape becoming the semi-spherical shape when the second member 222 is connected with the first member 221. The second member 222 is connected to the first member 221 detachably from the first member 221. An outer edge portion of the second member 222 being the bonding portion with the front case 21 is circular, and an inner edge portion of the second member 222 being the bonding portion with the first member 221 has an inverted U-shape whose lower side is opened. Since the second member 222 is supported by the first member 221, with the arrangement of the present embodiment in which the first member 221 is located in the lower side of the second member 222, stability is improved, and therefore, such arrangement is preferable.

As similar to the first member 221, the inner edge portion of the second member 222 has a shape in which the upper ends of the vertical sides 222*a* and 222*b* parallel to each other are connected via a curved lateral side 222*c*. That is, the first member 221 can be said as a shape extending to the opened portion of the second member. The second member 222 can be detached from the air blower 1 by being detached from the first member 221, can be cleaned alone, and can be washed with water as needed.

(Bonding of First Member 221 and Second Member 222)

As described above, the first member 221 and the second member 222 are bonded to each other in the inverted U-shape whose lower side is opened.

Figure 11:
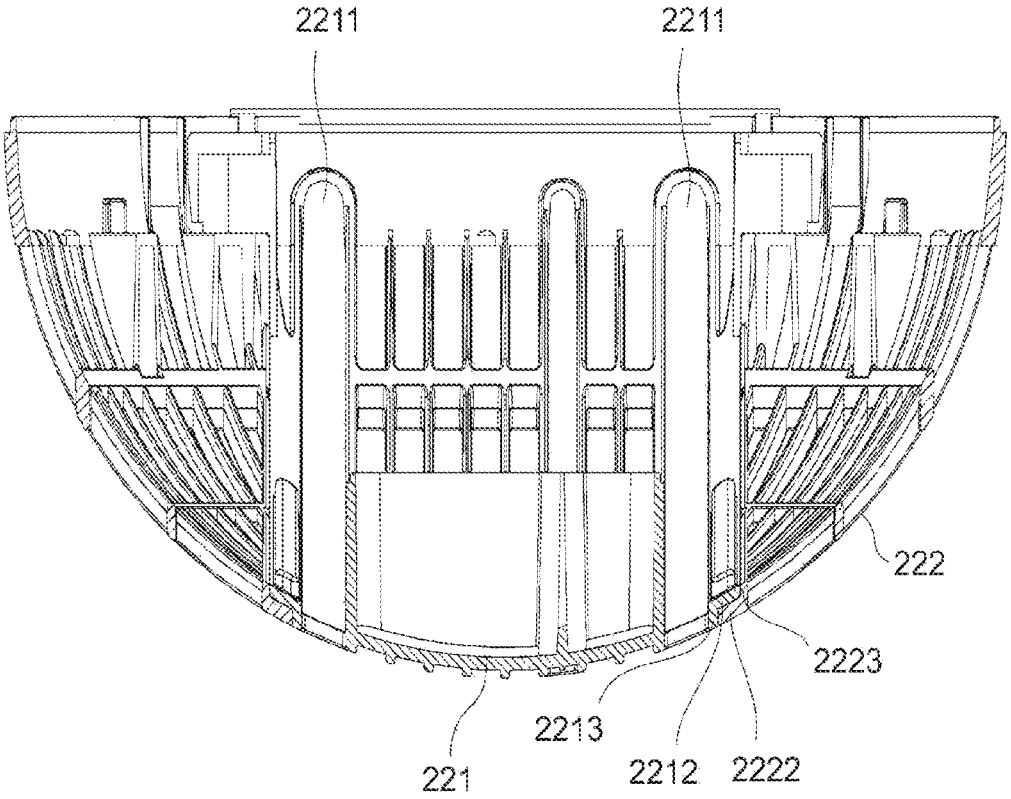
FIG. 11 is a cross-sectional view of a bonding portion of the first member and the second member at a position of A-A of FIG. 4.

FIG. 11 is a cross-sectional view including the bonding portion of the first member 221 and the second member 222 at a position of A-A of FIG. 4. In the bonding portion, the first member 221 includes a convex part 2212 in the inner surface side and a concave part 2213 in the outer surface side. The second member 222 includes a concave part 2223 in the inner surface side and a convex part 2222 in the outer surface side. In the inner surface side, the convex part 2212 of the first member 221 and the concave part 2223 of the second member 222 face each other. In the outer surface side, the convex part 2222 of the second member and the convex part 2213 of the first member 221 face each other. In this bonding portion, the inner surface and the outer surface of the first member 221 and the second member 222 are continuous. That is, the bonding portion of the first member 221 and the second member 222 has a mating structure having a stepped-shaped cross section. In other words, the first member 221 and the second member 222 are arranged so as to overlap with each other in the thickness direction in the bonding portion, and the thickness of the first member 221 and the second member 222 in the bonding portion is thin such that the thickness of the overlapping portion is about equal to the other portion of the first member 221 and the second member 222.

The rear case 22 of the air blower 1 has a configuration in which the first member 221 and the second member 222 are bonded in the mating structure as described above, so that a gap in the bonding part can be made inconspicuous. With this mating structure, even when there is a small gap between the first member 221 and the second member 222, occurrence of rattling can be suppressed. Particularly, when the first member 221 and the second member 222 are formed of a resin, a manufacturing variation such as a small strain is easy to occur, and therefore, the configuration is effective. Furthermore, with the mating structure, bonding strength of each bonding end of the first member 221 and the second member 222 is enhanced so it is difficult for the members to be broken.

As illustrated in FIG. 9, the edge portion of the first member 221 bonded with the second member 222 includes the vertical sides 221*a* and 221*b* and the lateral side 221*c*. On the other hand, as illustrated in FIG. 10, the edge portion of the second member 222 bonded with the first member 221 includes the vertical sides 222*a* and 222*b* and the lateral side 222*c*. The vertical sides 221*a* and 222*a* face each other, the vertical sides 221*b* and 222*b* face each other and the lateral sides 221*c* and 222*c* face each other. The vertical side 221*a* of the first member 221 is formed with a concave part 2214, the vertical side 221*b* is formed with a concave part 2215, and the lateral side 221*c* is formed with concave parts 2216, 2217. The vertical side 222*a* of the second member 222 is formed with a convex part 2224, the vertical side 222*b* is formed with a convex part 2225, and the lateral side 222*c* is formed with convex parts 2226 and 2227. That is, the concave parts 2214 to 2217 are long holes, and the convex parts 2224 to 2227 are protrusions provided so as to extend along the long holes. The concave parts 2214 to 2217 may be through holes or may be grooves having bottoms. The concave part 2214 and the convex part 2224 are formed at positions facing each other, the concave part 2215 and the convex part 2225 are formed at positions facing each other, the concave part 2216 and the convex part 2226 are formed at positions facing each other, and the concave part 2217 and the convex part 2227 are formed at positions facing each other, and they fit each other in a state where the first member 221 and the second member 222 are connected to each other.

As described above, with the configuration in which the first member 221 and the second member 222 have the concave parts 2214 to 2217 and the convex parts 2224 to 2227, respectively, positioning of the first member 221 and the second member 222 can be easily performed. Particularly, in the air blower 1, the user detaches the second member 222 from the first member 221 and attaches the second member 222 to the first member 221 every time the detachment is performed, and therefore, such a configuration in which positioning is easy is effective. Even when a small positional shift occurs between the first member 221 and the second member 222, the first member 221 and the second member 222 can be easily connected by fitting the convex parts and the concave parts. Particularly, when the first member 221 and the second member 222 are formed of a resin, a manufacturing variation such as a small strain is easy to occur, and therefore, the configuration is effective. A configuration may be adopted in which the first member 221 includes a convex part and the second member 222 includes a concave part.

In the above example, the convex parts 2224 to 2227 are protrusions provided so as to extend along the long holes of the concave parts 2214 to 2217, but may also be a plurality of protrusions provided along the long holes.

Figure 12:
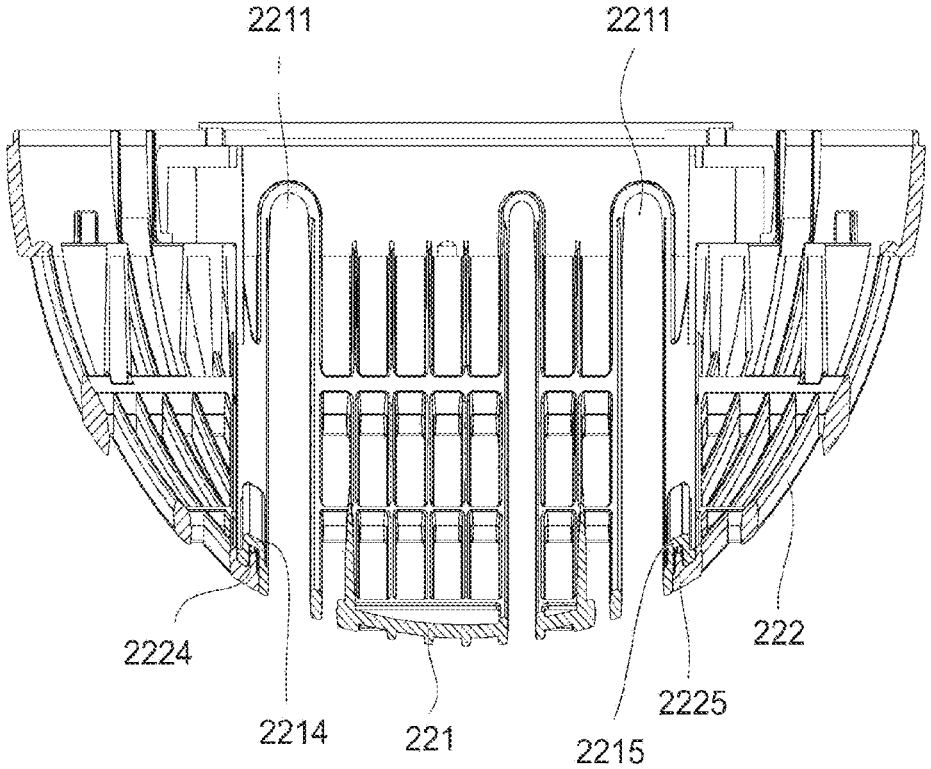
FIG. 12 is a cross-sectional view of the bonding portion of the first member and the second member at a position of B-B of FIG. 4.

FIG. 12 is a cross-sectional view of the bonding portion of the first member 221 and the second member 222 at a position of B-B of FIG. 4. As illustrated in FIG. 12, the convex parts 2224 and 2225 of the second member 222 are fitted to the concave parts 2214 and 2215 of the first member 221, respectively. The convex parts 2224 and 2225 each have a rounded and tapered corner portion and have a tapered surface. The concave parts 2216 and 2217 of the first member 221 and the convex parts 2226 and 2227 of the second member 222 also fit to each other in a similar manner, and the convex parts 2226 and 2227 each have a tapered shape having a tapered surface.

As described above, with the configuration in which the convex parts 2225 to 2227 of the second member 222 each have a tapered surface, a configuration is achieved in which the first member 221 and the second member 222 are easily fitted to each other due to a guiding action of the tapered surface at the time of fitting.

A configuration may be adopted in which, in the fitting structure by the concave parts and the convex parts of the first member 221 and the second member 222, the convex parts are press-fitted to the concave parts. With such a configuration, the position of the second member 222 with respect to the first member 221 is more stabilized.

As illustrated in FIGS. 6 and 9, the first member 221 includes screw holes 2218 and 2219 formed by a metal nut being embedded. The nut is embedded by insert molding when the first member 221 formed of a resin is molded. As a result, the nut is embedded in the first member 221 in a state where at least a part excluding the screw hole 2218 in the surface of the nut in the side formed with the screw hole 2218 is covered with the resin forming the first member 221. On the other hand, as illustrated in FIGS. 6 and 10, in the second member 222, through holes 2228 and 2229 are provided at positions facing the screw holes 2218 and 2219 of the first member 221. When the first member 221 and the second member 222 are connected with each other, the bolt is inserted into the through holes 2228 and 2229 of the second member 222 and screwed together the screw holes 2218 and 2219, and thereby, the bolt and the nut are screwed together.

By connecting the first member 221 and the second member 222 by screwing of the bolt and nut as described above, stable connection can be made. Furthermore, the screw hole can be prevented from being broken even when attachment and detachment of the first member 221 and the second member 222 are repeated. Furthermore, due to screwing of the bolt and the nut, the second member 222 can be prevented from falling from the first member 221 even when vibration occurs due to operation of the air blower 1. By embedding the nut to the first member 221 by insert molding, the nut for connection can be prevented from being lost. Furthermore, by embedding a metal nut not to the second member 222 that is attachable and detachable but to the first member 221, the second member 222 can be formed of only a resin. Such a configuration is preferable since there is no possibility that rust is generated in the metal member even when the second member 222 is washed with water.

Although the mechanism of the bonding of the first member 221 and the second member 222 has been described above, the configuration is not limited to these.

For example, the configuration for bonding or fitting the first member 221 and the second member 222 may be inverted or may be partially inverted. Specifically, a configuration in which the concave parts and the convex parts of the concave parts 2214 to 2217 of the first member 221 and the convex parts 2224 to 2227 of the second member 222 are inverted or a configuration in which two of four concave parts and convex parts are inverted may be adopted.

The case part 20 is formed in a spherical shape by fitting the front case 21 in which the grill 23 is embedded and the rear case 22 to each other. By making the blowing part 2 have a spherical shape in appearance, in addition to having a refined appearance, it appears more compact since there are no corners. Furthermore, a cute and fashionable feeling of appearance can be enhanced.

The grill 23 may be configured such that a circular ring intersecting with each fin 24 supports the plurality of fins 24 in order to prevent entering of a finger from a gap of the plurality of fins 24 and to reinforce the grill 23.

In an outer peripheral edge portion of the grill 23, a cylindrical air tunnel part 26 is provided. This air tunnel part 26 is a cylindrical member provided in the outside of the circumferential direction of the fan 27, and the inner diameter of the air tunnel part 26 is made to be substantially equal to the inner diameter of the blow port 2*a*. That is, in the air blower 1, the further inside than the portion where the air tunnel part 26 of the grill 23 is provided is the blow port 2*a* of the blowing part 2. In the air blower 1, by providing the cylindrical air tunnel part 26 inside of the blowing part 2, directivity and linearity of air being the action peculiar to a circulator are secured.

The motor 28 drives the fan 27. The motor 28 includes a motor body 28*a* and an output shaft 28*b* projecting forward from the motor body 28*a*. The distal end of the output shaft 28*b* is attached with the fan 27. When the motor 28 is driven, the output shaft 28*b* rotates, and thereby, the fan 27 rotates around the output shaft 28*b*.

The motor cover 29 holds the motor 28. Specifically, the motor body 28*a* is covered with and held by the motor cover 29 in a state where the output shaft 28*b* is inserted into an insertion hole 291 of the motor cover 29. The first member 221 of the rear case 22 is attached to the motor cover 29 in a fixed state and the support leg 33 of the support part 3 is rotatably connected to the motor cover 29.

As a result, by fitting the rear case 22 to the front case 21 fitted with the grill 23 in a state where the motor 28 and the fan 27 are attached to the rear case 22 via the motor cover 29, the blowing part 2 incorporated with a blower mechanism therein is formed.

[Support Part]

The support part 3 is placed on an installation surface such as a floor surface. The support part 3 is attached with a power supply cord 80. As illustrated in FIG. 8, the support part 3 includes a body portion arranged with the blowing part 2 in an upper part of the body portion and a pair of support legs 33 fixed to the body portion and supporting the blowing part 2 inside of the case part 20.

It is preferable that the size of the body portion of the support part 3 in plan view be almost the same as or equal to or less than the size of the blowing part 2 in plan view. As a result, as illustrated in FIG. 5, the size of the support part 3 in plan view can be made to be almost equal to the size of the blowing part 2 in plan view, and it is possible to prevent the entire of the air blower 1 from becoming too large. By making the size of the body portion of the support part 3 in plan view to almost the same size as the size of the blowing part 2 in plan view, the air blower 1 can be downsized while suppressing falling of the air blower 1. That is, the air blower 1 can be more stably placed while downsizing the air blower 1.

As illustrated in FIGS. 7 and 8, the body portion of the support part 3 includes a pedestal lower part 31 formed in a circular shape in plan view and a pedestal upper part 32 that can fit to the pedestal lower part 31. In both the pedestal lower part 31 and the pedestal upper part 32, the cover forming the outer surface can be formed of a synthetic resin material such as polypropylene.

The body portion of the support part 3 has a hollow inside and the inside accommodates the circuit substrate, the right-left swing mechanism, or the like.

In further rear than the center in the cover of the pedestal upper part 32, a strut part 321 having a one-leg shape is erected perpendicularly. In further front than the strut part 321 in the cover of the pedestal upper part 32, an operation panel 323 is arranged. In the upper part of the upper surface 322 of the strut part 321, the blowing part 2 is arranged in a state where there is a gap provided between the blowing part 2 and the upper surface 322.

The operation panel 323 is provided with, for example, a power button for switching on/off of power, an air volume button for adjusting an amount of air in the blowing part 2 and a swing button for switching on/off of right-left swing.

As illustrated in FIG. 8, the support leg 33 is pivotally attached to the motor cover 29 rotatably in the up-down direction in a state of being inserted into the slit 2211 of the rear case 22. A lower end of the support leg 33 is fixed to the pedestal upper part 32 of the body portion of the support part 3.

Specifically, the upper sides of the support legs 33 are connected to both sides of the motor cover 29 in the width direction via a cylindrical shaft part. As a result, the motor cover 29 is supported rotatably in the up-down direction with respect to the support part 3 in a state of being held between the pair of support legs 33. The motor cover 29 holds the motor 28 and the fan 27 is connected to the motor 28. The motor cover 29 is fixed with the first member 221. The first member 221 is fixed to the front case 21 and is connected with the second member 222 detachably from the second member 222. That is, when the motor cover 29 rotates in the up-down direction with respect to the support leg 33, the blowing part 2 including the motor cover 29, the motor 28, the fan 27 and the case part 20 including the front case 21 and the rear case 22 rotates in the up-down direction with respect to the support leg 33 fixed to the support part 3.

It is preferable that the shaft part through which the support leg 33 and the motor cover 29 are connected is provided in the vicinity of the center of the case part 20 being circular in plan view, when the air blower 1 is viewed from the side. With such arrangement, rotation in the up-down direction around the center portion of the spherical case part 20 is enabled.

That is, the air blower 1 is configured such that, when the motor cover 29 pivotally attached to the pair of support legs 33 is rotated with respect to the support part 3, the entire blowing part 2 rotates in the up-down direction with respect to the support part 3. At this time, the support leg 33 rotates in a region formed with the slit 2211, the movable range of the blowing part 2 in the up-down direction is determined by the length of the slit 2211.

The motor cover 29 may be configured to rotate in the up-down direction by a motor not illustrated, or may be manually rotated in the up-down direction, with respect to the support leg 33. In the configuration in which the motor cover 29 rotates in the up-down direction by the motor, in addition to the motor 28 that rotates the fan 27, a motor that rotates the shaft part connected with the support leg 33 is provided.

The air blower 1 includes a right-left swing mechanism that causes swing in the right-left direction to change the air blowing direction. The right-left swing mechanism includes a motor not illustrated provided inside of the pedestal upper part 32. The motor of the right-left swing mechanism rotates a rotation shaft extending in the up-down direction. The pedestal lower part 31 and the pedestal upper part 32 are connected with each other via the rotation shaft therebetween. Therefore, when the motor of the right-left swing mechanism rotates, the pedestal upper part 32 is rotated in the right-left direction with respect to the pedestal lower part 31. The support leg 33 is fixed to the pedestal upper part 32, and the motor cover 29 is connected to the support leg 33. That is, when the motor of the right-left swing mechanism rotates, the blowing part 2 swings in the right-left direction with respect to the support part 3, and performs swinging.

[Modification]

Figure 13:
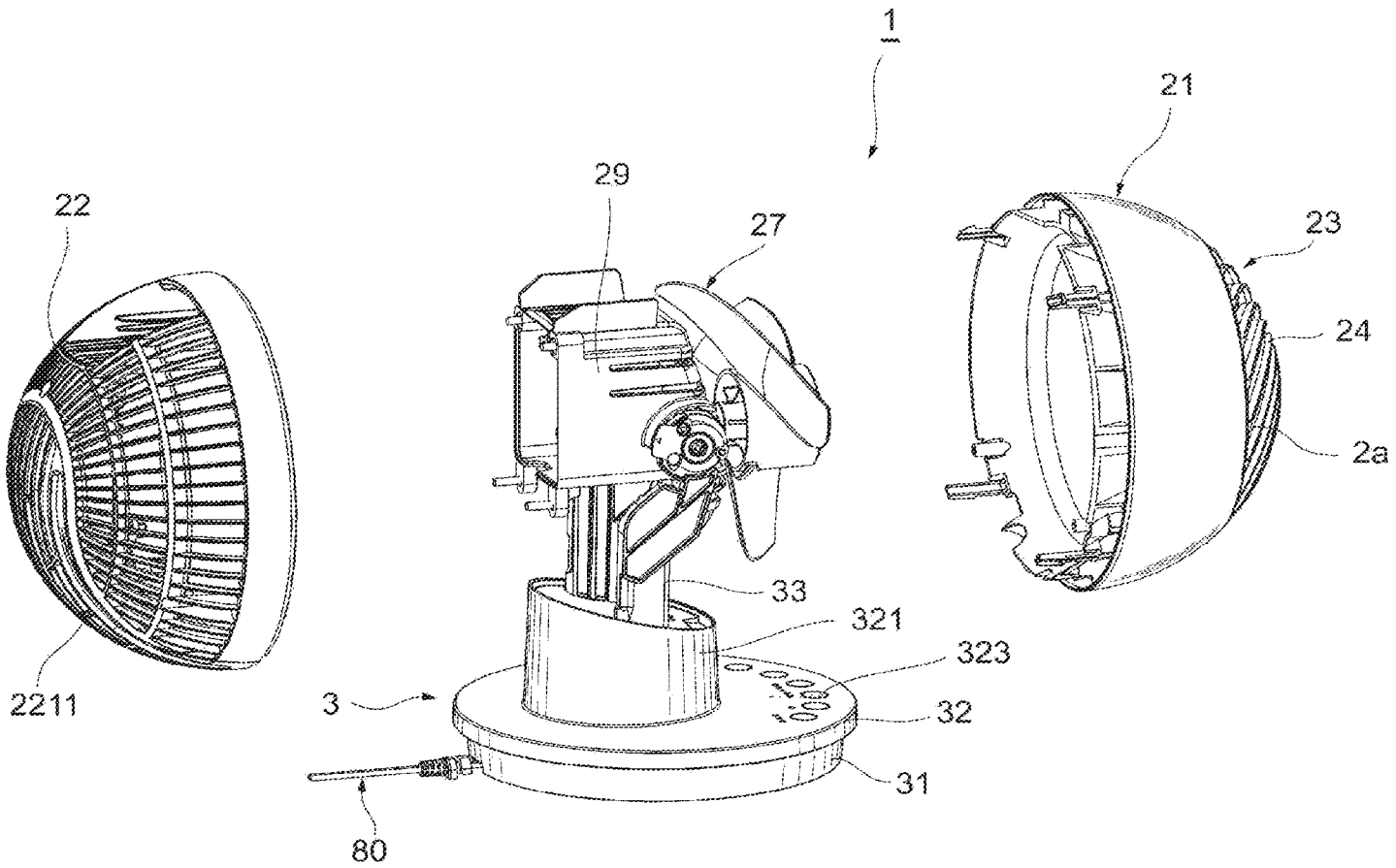
FIG. 13 is a perspective view from the rear of an air blower according to a first modification in which a second member has been detached.

The configuration of the air blower is not limited to the configuration of the air blower 1 according to the above-described embodiment. For example, as illustrated in FIG. 13, a configuration may be adopted in which the first member 221 and the second member 222 of the rear case 22 are integrated such that they cannot be detached from each other, and the rear case 22 can be detached from the air blower 1 body. In this case, since the front case 21 is supported by the support leg 33 via the rear case 22, the front case 21 is also detachable from the body of the blowing part 2. In this configuration, the slit 2211 is formed so as not to interfere with the support leg 33 when the rear case 22 is detached. It is sufficient that the lower end of the slit 2211 is opened, for example. With such a configuration, the entire case part 20 can be cleaned by detaching the case part 20 from the support part 3.

Figure 14:
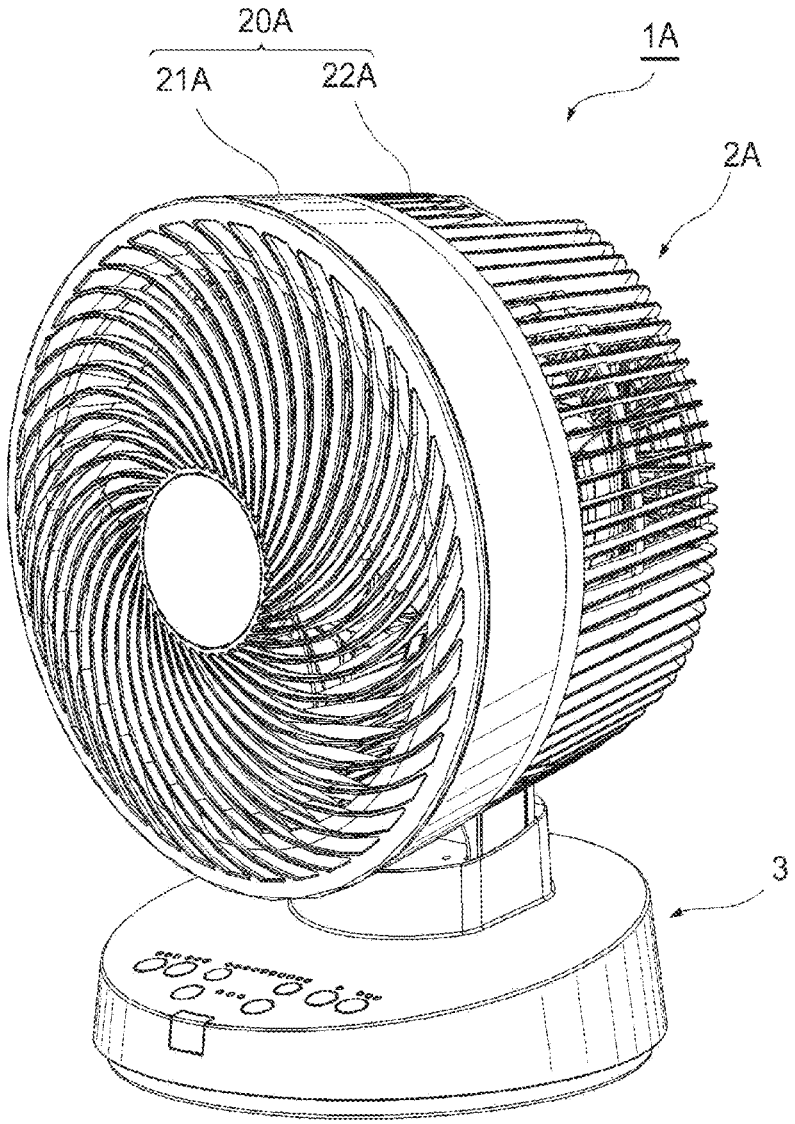
FIG. 14 is an external perspective view from the front of an air blower according to a second modification.
Figure 15:
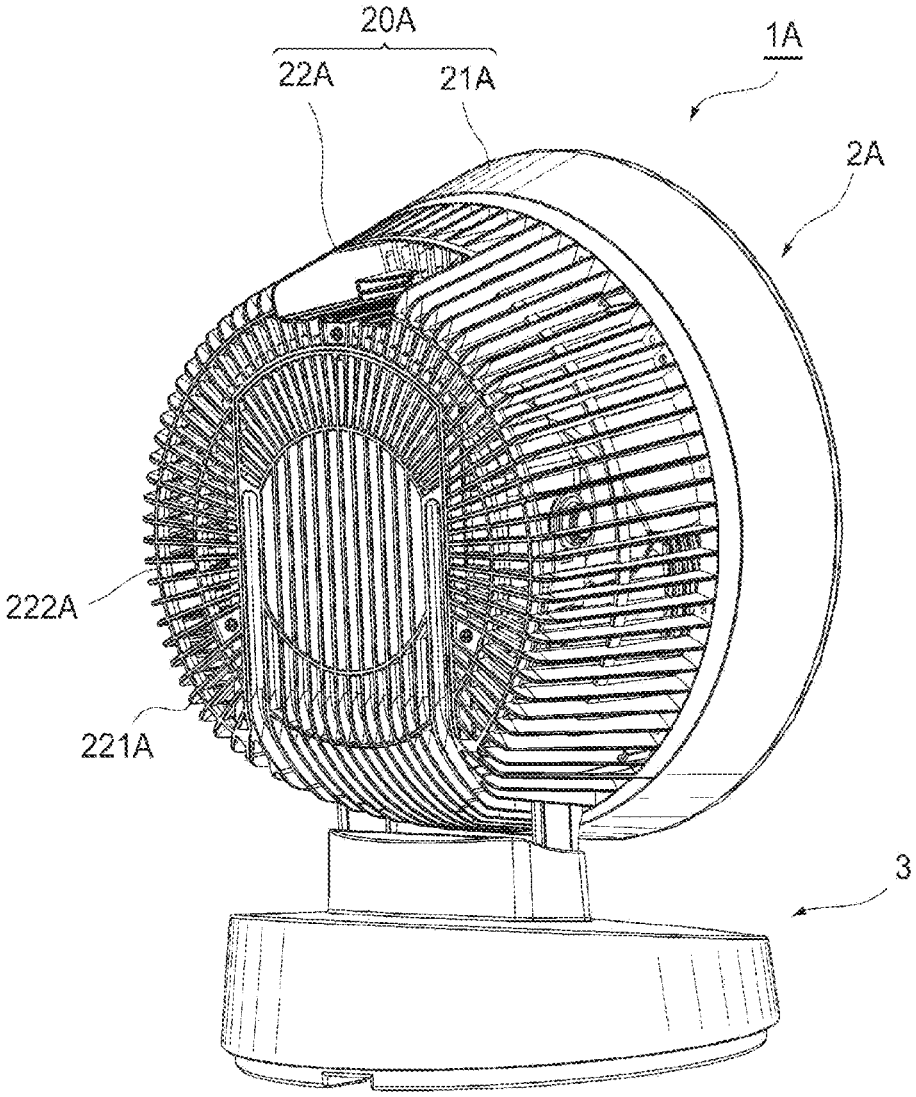
FIG. 15 is an external perspective view from the rear of the air blower according to the second modification.
Figure 16:
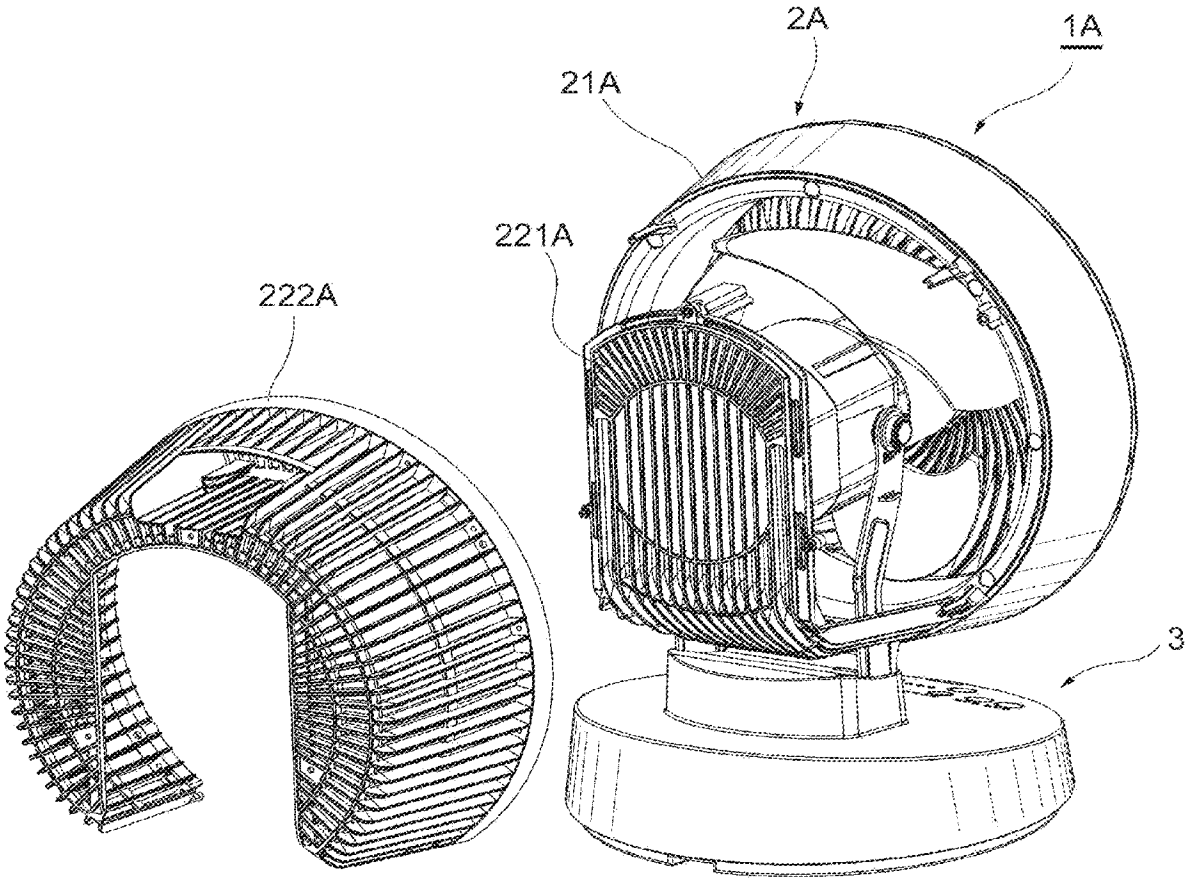
FIG. 16 is a perspective view from the rear of the air blower according to the second modification in which a second member has been detached.

The air blower may have such a configuration as that of the air blower 1A illustrated in FIGS. 14 to 16. FIGS. 14 and 15 are perspective views of the air blower 1A according to the modification, FIG. 14 is the front view, and FIG. 15 is the rear view. FIG. 16 is a perspective view from the rear of the air blower 1A in which a second member 222A is detached from a first member 221A of a rear case 22A.

In the air blower 1A, the outer shell of a case part 20A does not have a spherical shape, and has a cylindrical shape whose diameter gradually increases toward forward. The case part 20A includes a front case 21A and the rear case 22A that can be divided at a front-and-rear intermediate position. The rear case 22A includes the first member 221A and the second member 222A. The second member 222A is attached to the first member 221A detachably. The configuration of the first member 221A is common to the configuration of the first member 221 of the air blower 1 except for the contour, and the configuration of the second member 222A is common to the configuration of the second member 222 of the air blower 1 except for the contour.

In the air blower 1 according to the embodiment, the slit 2211 is formed in the first member 221. However, the mode is not limited to this. The slit 2211 may be formed in the second member 222, or may be formed between the first member 221 and the second member 222. However, when the slit 2211 is formed in the second member 222, the shape of the slit 2211 needs to be opened shape such that the slit 2211 and the support leg 33 do not interfere with each other when the second member 222 is detached from the first member 221. Specifically, a configuration is adopted in which the lower end of the slit 2211 extends to the edge portion of the second member 222, and this edge portion is opened.

[Feature of Air Blower]

The air blower 1 described in this specification has a configuration in which the second member 222 of the rear case 22 is connected to the first member 221 detachably, and therefore, the second member 222 can be detached from the air blower 1. This configuration facilitates removing dust accumulated in the air intake port 22*b* and cleaning the second member 222 by detaching the second member 222.

The embodiment and modification of the present invention have been specifically described above. These embodiment and modification are merely specific examples as a configuration example and an operation example of the present invention. The scope of the present invention is not limited to these and shall be construed widely to the range that can be recognized by a person skilled in the art on the basis of similar technical ideas.

REFERENCE SIGNS LIST

1, 1A Air blower
2 Blowing part
2*a* Blow port
20, 20A Case part
21, 21A Front case
21*a* Opening
22, 22A Rear case
221 First member
2211 Slit
2212 Convex part
2213 Concave part
2214 to 2217 Concave part
2218 Screw hole
222 Second member
2222 Convex part
2223 Concave part
2224 to 2227 Convex part
2228 Through hole
22*a* Crosspiece
22*b* Air intake port
23 Grill
24 Fin
26 Air tunnel part
27 Fan
28 Motor
28*a* Motor body
28*b* Output shaft
29 Motor cover
291 Insertion hole
3 Support part
31 Pedestal lower part
32 Pedestal upper part
321 Strut part
322 Upper surface
323 Operation panel
33 Support leg
80 Power supply cord

What is claimed is:

1. An air blower comprising a blowing part including:

a fan;

a motor for driving the fan;

a motor cover holding the motor; and a case part storing the motor cover, wherein the case part includes a first member fixed to the motor cover, and a second member connected to the first member detachably, having an air intake port through which air that the fan takes in flows; and wherein the second member has a shape whose lower side is opened, and the first member has a shape extending to an opened portion of the second member.

2. The air blower according to claim 1, further comprising a support part including a support leg inserted into a slit of the case part and pivotally attached to the motor cover.

3. The air blower according to claim 2, wherein the slit is formed in the first member.

4. The air blower according to claim 1, wherein, in a cross section of a bonding part of the first member and the second member, each of the first member and the second member has one surface side projecting with respect to the other surface side, and the first member and the second member are bonded to each other such that a convex part of the first member faces a concave part of the second member and a concave part of the first member faces a convex part of the second member.

5. An air blower comprising a blowing part including:

a fan;

a motor for driving the fan;

a motor cover holding the motor; and a case part storing the motor cover, wherein the case part includes a first member fixed to the motor cover, and a second member connected to the first member detachably, having an air intake port through which air that the fan takes in flows, wherein the first member and the second member each have a convex part and a concave part fitting to each other in a surface facing an attaching and detaching direction of each other, wherein the concave part is a long hole and the convex part is a protrusion provided so as to extend along the long hole at a position corresponding to the long hole.

6. An air blower comprising a blowing part including:

a fan;

a motor for driving the fan;

a motor cover holding the motor; and a case part storing the motor cover, wherein the case part includes a first member fixed to the motor cover, and a second member connected to the first member detachably, having an air intake port through which air that the fan takes in flows, wherein the first member and the second member each have a convex part and a concave part fitting to each other in a surface facing an attaching and detaching direction of each other, wherein the concave part is a long hole and the convex part is a protrusion provided in plural along the long hole at a position corresponding to the long hole.

* * * * *